United States Patent [19]

Boyesen

[11] 4,143,626

[45] Mar. 13, 1979

[54] INJECTOR PORTING FOR TWO CYCLE INTERNAL COMBUSTION ENGINE

[75] Inventor: Eyvind Boyesen, Kempton, Pa.

[73] Assignee: Performance Industries, Inc., Kempton, Pa.

[21] Appl. No.: 859,476

[22] Filed: Dec. 12, 1977

Related U.S. Application Data

[63] Continuation-in-part of Ser. No. 839,180, Oct. 4, 1977, and Ser. No. 674,102, Apr. 6, 1976, Pat. No. 4,062,331, which is a continuation-in-part of Ser. No. 586,138, Jun. 11, 1975, Pat. No. 4,051,820, which is a continuation-in-part of Ser. No. 375,065, Jun. 29, 1973, Pat. No. 3,905,340, which is a continuation-in-part of Ser. No. 282,734, Aug. 22, 1972, abandoned, and Ser. No. 361,407, May 18, 1973, abandoned.

[51] Int. Cl.[2] ..... F02B 33/04

[52] U.S. Cl. ..... 123/73 A; 123/73 B

[58] Field of Search ..... 123/73 A, 73 AA, 73 B, 123/73 PP, 73 R, 73 V

[56] References Cited

U.S. PATENT DOCUMENTS

| | | | |
|---|---|---|---|
| 1,105,298 | 7/1914 | Peterson | 123/73 AA |
| 3,107,659 | 10/1963 | Steinlein et al. | 123/73 V |
| 3,687,118 | 8/1972 | Nomura | 123/73 A |
| 3,752,129 | 8/1973 | Kobayashi et al. | 123/73 A |
| 4,026,254 | 5/1977 | Ehrlich | 123/73 AA |
| 4,062,331 | 12/1977 | Boyesen | 123/73 A |
| 4,075,985 | 2/1978 | Iwai | 123/73 A |

FOREIGN PATENT DOCUMENTS

| | | | |
|---|---|---|---|
| 280597 | 12/1930 | Italy | 123/73 A |

*Primary Examiner*—Charles J. Myhre
*Assistant Examiner*—David D. Reynolds
*Attorney, Agent, or Firm*—John T. Synnestvedt; Kenneth P. Synnestvedt

[57] ABSTRACT

A two-cycle internal combustion engine having reed-type intake valving, and multiple injector passages and porting constructed and arranged to improve various of the operating characteristics of the engine, and particularly adapted to increase the effectiveness of fuel injection through the injector passages.

17 Claims, 6 Drawing Figures

11b
39
21b
36
36'
11c
14b
4
24
4
13b
23b
27b
19b
30c
22b
30b
26w
19d
13b
26a
26b
6

19b
11c
19d
11b
30b
30c
25
13b
39
29b
27b
3
23b
24
28b
6
3
13b
29b
13b
27b
23b
19b
11c
30c
22b
30b
19d

INJECTOR PORTING FOR TWO CYCLE INTERNAL COMBUSTION ENGINE

CROSS REFERENCES

The present application is a continuation-in-part of my prior application Ser. No. 839,180, filed Oct. 4, 1977, and of my application Ser. No. 674,102, U.S. Pat. No. 4,062,331 filed Apr. 6, 1976, which latter is a continuation-in-part of my application Ser. No. 586,138, U.S. Pat. No. 4,051,820 filed June 11, 1975, which in its turn is a continuation-in-part of my application Ser. No. 375,065, U.S. Pat. No. 3,905,340 filed June 29, 1973, which in its turn is a continuation-in-part of my prior application Ser. No. 282,734, filed Aug. 22, 1972, now abandoned, and of my prior application Ser. No. 361,407, filed May 18, 1973, now abandoned. Said application Ser. No. 375,065 has now matured as U.S. Pat. No. 3,905,340. Applications bearing Ser. Nos. 416,213, and 416,215, filed Nov. 15, 1973, are divisions of Ser. No. 375,065 and, said application Ser. No. 416,215 is now U.S. Pat. No. 3,905,341, and said application 416,213 is now U.S. Pat. No. 4,000,723. Application Ser. No. 586,138 is now U.S. Pat. No. 4,051,820, issued Oct. 4, 1977.

BACKGROUND OF THE INVENTION

As in my prior patents and applications just identified, the present invention has the general objective of improving the performance, power output, flexibility, response and fuel economy of internal combustion engines, especially two-cycle, variable speed, crankcase compression engines as used for a variety of purposes, for example on motorcycles.

While having important features in common with certain of the prior patents and applications identified above, the present application contemplates alternative arrangements and further improvements as compared with my prior patents and applications, as is more fully explained hereinafter.

In considering some of the major general objectives of the invention it is first noted that performance characteristics of engines, and especially of two-cycle engines, are determined in large part by the fuel intake capabilities, which are in turn governed in part by the total cross-sectional area of the intake passages, the length and the directness of the path of flow of the incoming fuel, the duration of the intake, the portion of the cycle during which intake occurs, and the responsiveness of the action of the intake valves. With these factors in mind the present invention, and the inventions of my above identified patents and applications, provide novel arrangements and interrelationships of intake porting and reed valves which mutually contribute to an increase in the cross-sectional intake flow area for the fuel, and to an extension of the portion of the cycle during which intake of fuel occurs, and which shorten and make more direct the flow path of the incoming fuel.

The features of the present invention which contribute to the foregoing general objectives are explained in detail below. However, it is first noted that a brief description of the prior art in this field is included in my prior patents and applications. In this connection see for example the description in my U.S. Pat. No. 3,905,340. For the purposes of the present disclosure, the following brief additional discussion will be helpful as background material.

Important aspects of my developments, disclosed and claimed in my earlier cases, particularly in U.S. Pat. No. 3,905,341 and in applications Ser. No. 674,102 and Ser. No. 586,138, have to do with what I have referred to as "injector" ports, and with the fact that such ports may advantageously be used in combination with other novel intake porting and with the passages commonly used in the industry to transfer the compressed fuel mixture from the crankcase to the combustion side of the piston.

SUMMARY OF THE INVENTION

It is first desired to point out that in typical two-cycle engines, fuel is introduced into the crankcase and is compressed by a downward stroke of the piston. One or more transfer passages are usually associated with the cylinder structure, with a lower port communicating with the crankcase and with an upper port in the cylinder wall in a position to be uncovered by the downward movement of the piston when it approaches bottom dead center. An exhaust port is also provided in the wall of the combustion chamber in a position to be opened when the piston approaches the lower end of its downward stroke.

Upon opening of the transfer port, the compressed fuel flows through the transfer passage from the crankcase to the combustion side of the piston, and the piston thereafter moves upwardly, closing off the transfer port and also the exhaust port, and the fuel is compressed by the upward movement of the piston in the combustion chamber and is ignited so as to induce the downward motion of the piston and thus develop the power of the engine.

Intake or inlet means for the fuel to be used is also provided, such means ordinarily including the intake passages customarily provided with valves, for instance with one or more valves of the reed or reed petal type, the valves and intake passages being angularly spaced about the axis of the cylinder from the transfer passages and ports. In many engines, a pair of transfer passages are provided, being positioned at opposite sides of the cylinder usually in an axial plane approximately at right angles to the axial plane of the intake passage. In certain engines, pairs of transfer passages are provided at opposite sides of the cylinder.

Various arrangements have been used in an effort to increase the amount of fuel introduced into the combustion chamber above the piston, some of these arrangements being disclosed in various of my prior applications above referred to. One of the expedients employed for the purpose of increasing the amount of fuel introduced into the combustion chamber is the provision of passages, which in various of my prior applications have been referred to as "injector" passages. Passages of this type are arranged to communicate with the intake chamber or intake passage and with the transfer passage or passages, thereby providing a path for flow of fuel directly from the intake chamber to the transfer passage, without previous introduction into or compression in the crankcase. Such injector passages are particularly effective when used in combination with reed type valves which are positioned in the intake channel between the injector passage means and the source of supply of fuel (for instance a carburetor). In general, these injector passages are effective for the purpose referred to by virtue of Bernoulli and/or Venturi effects occurring at the junction of the injector passages with the transfer passages. In other words, the flow of the fuel after compression thereof in the crankcase upwardly through the transfer passages to the combustion chamber above the piston establishes a pressure condition in the transfer passage means inducing flow from the intake chamber through the injector passages and into the fuel flowing upwardly through the transfer passages into the combustion chamber. This action is referred to herein as injection of fuel and the passages and ports through which it occurs are referred to as injector passages or injector ports.

With the foregoing in mind, it is now pointed out that it is an object of the present invention to further enhance, improve or augment the fuel injection provided by "injector" passages and ports.

According to the present invention, several improved arrangements are provided, as follows:

First, in a typical engine having a single transfer passage at opposite sides of the cylinder, and having an intake channel with reed valves and intake porting in a position between the two transfer passages, the invention contemplates employment of two injector passages for each transfer passage, one of which connects the intake channel with the transfer passage at a point spaced from the transfer port in the cylinder wall, and the other of which connects the intake channel with the transfer passage substantially at the zone of the transfer port. The invention thus provides for two injector passages cooperating with a single transfer passage; and in this way, the invention provides a means for increasing the fuel injection into the combustion chamber.

Second, in an engine in which a pair of transfer passages is provided at each side of the cylinder, the invention provides for separate injector passages at each side of the cylinder, one injector passage being connected with at least one transfer passage and the other injector passage at that side being connected with the other transfer passage. Preferably also in this configuration, the point of connection of one of the injector passages with at least one of the transfer passages is close to the transfer port into the combustion chamber, and the other injector passage at that side is connected with the other transfer passage at a point spaced from the port into the cylinder.

By providing the foregoing types of combinations of multiple injector passages with either single or multiple transfer passages, it is possible to substantially increase the injection of fuel into the engine. In addition, the arrangements as referred to also provide a desirable spread of the increased fuel injection over the speed range of the engine, as will be explained more fully hereinafter.

According to the invention, the multiple injector passages associated with the transfer passage means at each side of the cylinder preferably also respectively comprise an injector passage formed as a "hogged out" channel in the cylinder wall, and an injector passage drilled or otherwise formed within the wall structure of the engine. In this way, it is possible to provide the extensive increase in fuel injection without resorting to any one very large injector flow passage formed either within the structure of the cylinder or as a hogged out channel in the cylinder wall. It is, therefore, an additional objective of the invention to provide for increase in the fuel injection without appreciable adverse effect upon the structure of the cylinder.

It is also an object of the invention to provide multiple injector passage means respectively cooperating with different reed valves associated with the intake system, so that each injector passage may function to its maximum efficiency without being influenced by the pressure conditions prevailing in another injector passage.

In all embodiments of the invention, provision is made for transfer of compressed fuel from the space below the piston including the crankcase to the combustion chamber; and at the same time in all embodiments, intake porting is provided for introducing fuel from the fuel supply chamber into the space below the piston independently of the fuel flow through the transfer passage or passages. Moreover, at least some fuel intake or fuel supply passage means is provided in such position with relation to the piston that the supply passage means is not closed by the piston at any point throughout the cycle of operation of the engine. This provision for fuel intake independently of the transfer of fuel from the crankcase to the combustion chamber enhances the fuel supply, because at no point in the cycle of operation is it necessary for the flow in the intake passage to reverse its direction.

As will become apparent as this description proceeds, my improved apparatus is also featured by virtual elimination of the short circuiting of fuel which has occurred in certain engines. For example, in certain engines using booster, or so-called "auxiliary scavanging" passages extended from the intake chamber directly into the combustion space, there has been a loss of efficiency as a result of some of the fuel, inletted into the cylinder through the transfer porting, flowing back through the booster passage and into the intake area when the piston is close to the bottom dead center position. In contrast, as above mentioned, in the arrangements provided by the present invention the flow is a one-way flow in all passages, there being no tendency or necessity for flow reversal in any of the passages.

In certain of the embodiments described hereinafter, the injector and intake porting have portions in common, which portions are comprised, at least in major part, by cavities recessed in the wall of the cylinder liner or other housing, and openly confronting outside surface portions of the piston.

BRIEF DESCRIPTION OF THE DRAWINGS

How the foregoing and other objects and advantages are achieved, will be clear from the following detailed description referring to the accompanying drawings, in which.

Before considering the drawings in detail, it is first pointed out that FIGS. 1, 2, 3 and 4 are respectively closely similar to FIGS. 1, 2, 3 and 4 of my prior application Ser. No. 839,180 identified above. It is also noted that FIG. 6 is substantially the same as FIG. 5 of said application Ser. No. 839,180. However, it is here pointed out that in each of FIGS. 1 to 4 inclusive, additional illustration is included, indicating the multiple injector port arrangements contemplated by the present invention. Since much of the structure which appears in FIGS. 1 to 4 inclusive and also in FIG. 6 is shown and described in the companion application referred to, reference may be had to said companion application for further amplification. Significant parts of the apparatus shown in these figures is described herebelow, and portions of this description correspond to portions appearing in the companion application where the structural features are the same.

DETAILED DESCRIPTION OF THE ILLUSTRATED EMBODIMENTS

Figure 1:
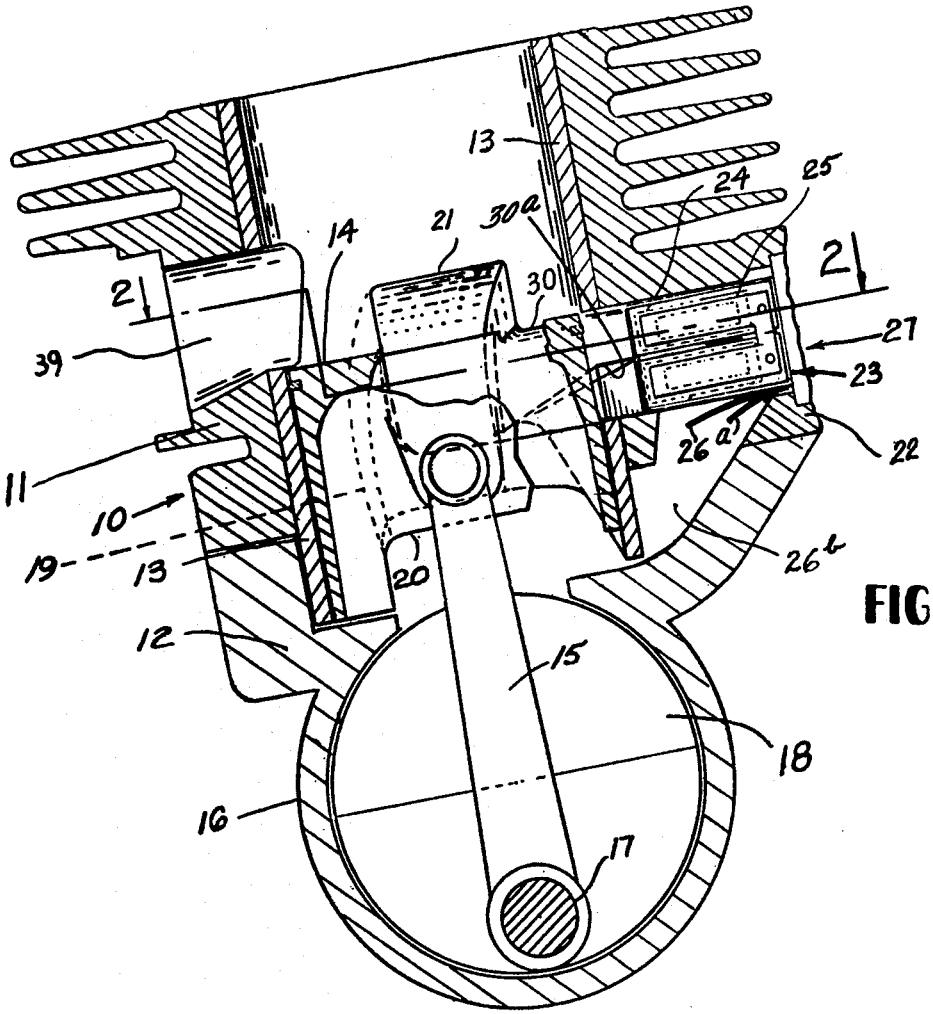
FIG. 1 is a view in section, taken along the line 1—1 of FIG. 2, and illustrating a two-cycle reed valve engine having intake and injector porting characteristic of this invention.
Figure 2:
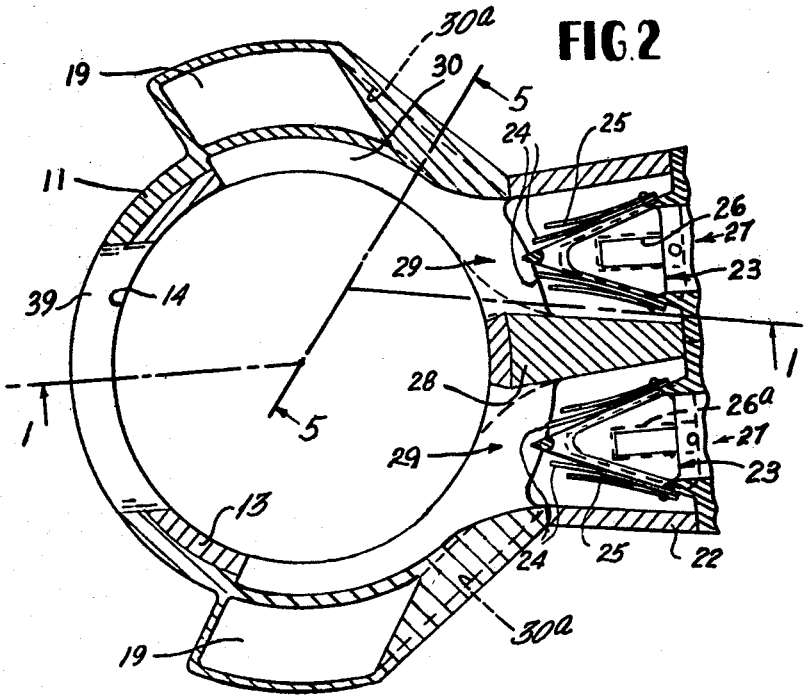
FIG. 2 is a sectional view taken along the line 2—2 of FIG. 1.
Figure 5:
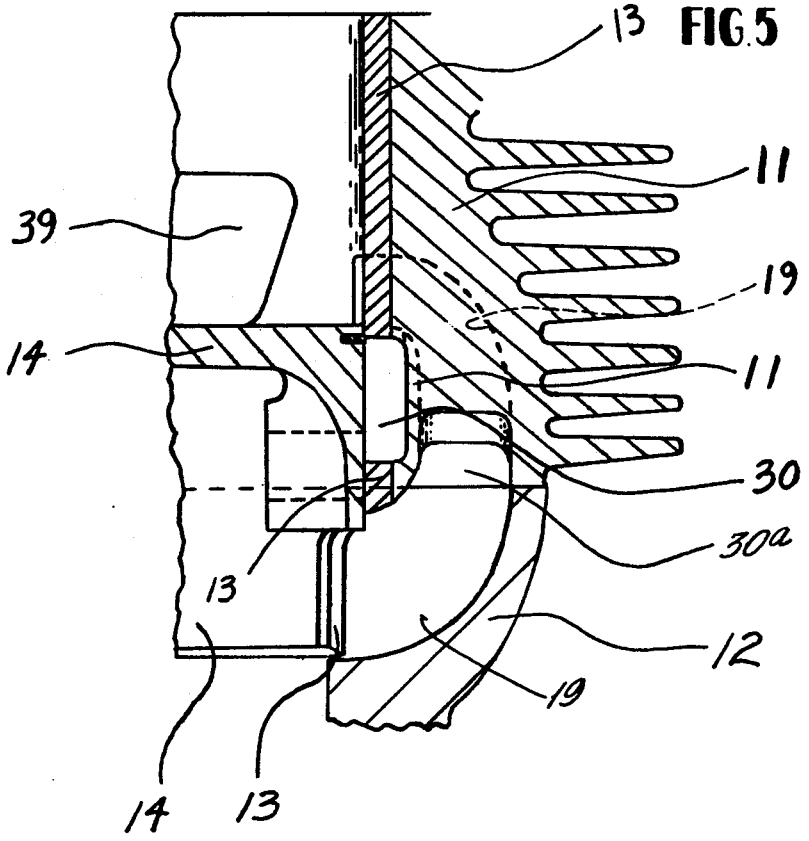
FIG. 5 is a vertical sectional view, taken substantially along the line 5—5 of FIG. 2.
Figure 6:
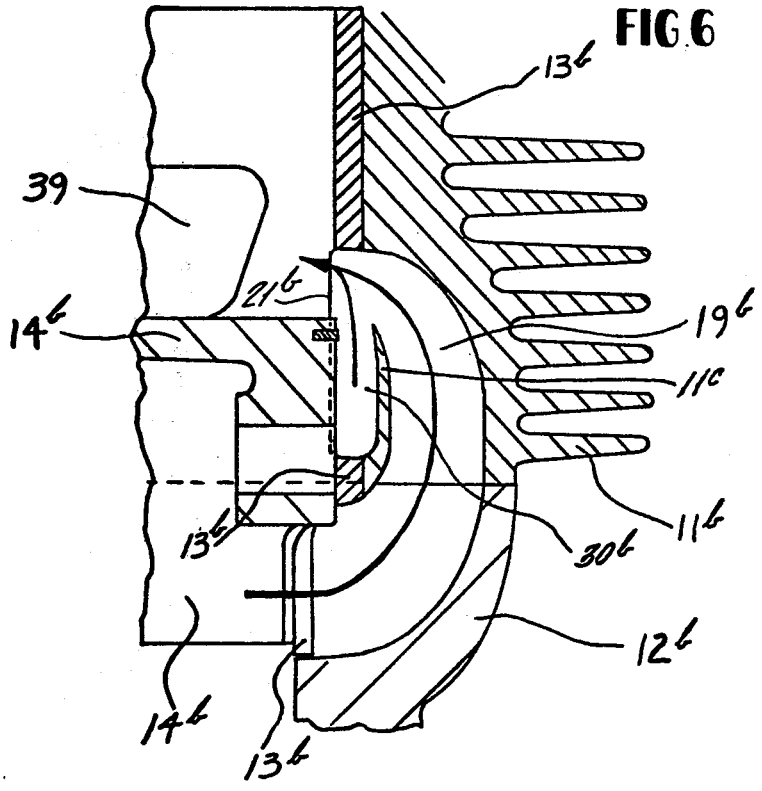
FIG. 6 is a vertical sectional view taken substantially along the line 6—6 of FIG. 4.

First making reference to the embodiment of FIGS. 1, 2 and 5, there is shown a somewhat diagrammatic representation of a two-cycle engine comprised of a housing 10 the upper portion of which defines a cylinder 11 and the lower portion of which defines a crankcase 12. The upper, annular portion of the crankcase interfits with cylinder liner structure 13, which extends throughout the height of the cylinder 11, except where omitted or removed to provide certain porting (including the usual exhaust port 39), and projects beneath it in the manner plain from FIG. 1. While the use of a liner is preferred, it is not essential, and for most purposes of the present invention, the liner can be considered as a part of the cylinder 11, which, in turn, forms the upper portion of housing 10. A piston 14 is mounted for reciprocation within the cylinder and its connecting rod 15 is eccentrically mounted upon the crankshaft within the lower portion 16 of the crankcase, as indicated at 17. As is conventional, a circular counterweight is preferably employed, as shown at 18.

The cylinder 11 includes transfer passages 19, the lower end of each of which is in open communication with the crankcase and the upper end of each of which terminates in a port 21 opening through the cylinder wall and into the space lying to the combustion side of piston 14. As will be understood, it is preferred to employ at least two such transfer passages (see FIG. 2) and one thereof appears in FIG. 1 at 19, its lower end 20 having the stated open communication with the crankcase and its upper end terminating in the aforesaid port shown at 21. Conveniently, and as shown, the passage 19 is provided in the wall of cylinder 11, lying behind the liner 13, which is apertured to provide the lower communication at 20 as well as the upper port 21. As is conventional, combustable gases inletted during the upward stroke are pressurized beneath the piston and in the crankcase, by the piston throughout its downward stroke toward the bottom dead center position illustrated, and the gases flow from the crankcase through openings 20, passages 19 and ports 21, from whence the gases enter the cylinder above the piston 14.

The cylinder 11 also includes an intake chamber 22 which leads to a source of fuel (not illustrated) and which chamber contains the reed valve means 23, which is adapted to open and provide for intake of fuel throughout the entire upward stroke of the piston, and to close, during the downward stroke of the piston, when the fuel inletted into the space below the piston is being compressed. While, for certain purposes of the present invention, the reed valve means 23 may take a variety of forms known in the art, it is preferred that said reed valve means be of the so-called "vented" type described and claimed in my earlier disclosures and particularly in U.S. Pat. No. 3,905,340, to which reference may be had for a more detailed description, and further in that the valve means includes a plurality of valve assemblies as described hereinafter.

In the embodiment illustrated in FIGS. 1 and 2, the reed valve means 23 includes a reed valve body or cage of wedge shape, with the base end of the wedge open to the fuel supply passage, each inwardly inclined surface of the wedge-shaped cage having a pair of valve ports and each such port provided with primary and secondary reeds 24 and 25, the primary reeds being vented. This valving arrangement is more fully illustrated and described in my U.S. Pat. No. 3,905,340 above identified.

The opposite sides or ends (top and bottom) of the reed valve cage are provided with parallel triangular walls; and in the construction shown in FIGS. 1 and 2, the lower triangular wall of the valve cage is provided with a valve port 26 with which a pair of primary and secondary reed valves 26*a* are associated. In this case also, the primary reed is vented and is of the general type described in my prior U.S. Pat. No. 3,905,340.

From FIG. 2, it will be seen that the embodiment of FIGS. 1 and 2 includes two valve assemblies 23 arranged in side-by-side relation and positioned respectively in separate intake passages 29, 29 lying at opposite sides of the dividing wall 28. The fuel entering through the valves 24, 25 flows directly into the cylinder intake passages 29 and also laterally and downwardly into the intake passages 26*b*, referred to hereinafter. From FIG. 1, it will also be seen that the intake passages 26*b* are extended downwardly and laterally from the lower side of each reed cage and thereby provide communication with the crankcase independently of the passages 29. The reed valves 26*a* of each valve assembly control the fuel flow from the interior of the reed cage into the associated intake passage 26*b*, and this flow joins the downward fuel inlet flow coming from the valves 24, 25. From FIG. 1, it will also be observed that the passages 26*b* communicate with the crankcase at a point below the piston skirt laterally at each side of the vertical plane of the reed cages, even when the piston is in BDC, as in FIG. 1. The communication through the valves 26*a*, the passages 26*b* and into the crankcase, is thus maintained throughout the entire cycle of operation of the engine, and the flow would, of course, only be terminated when the compression is occurring in the crankcase, with consequent increase in pressure communicated back to the valve structure, thereby permitting the valves 26*b* to close.

It is desirable, as shown in FIGS. 1 and 2, that each reed cage be positioned with its apex extended in a vertical direction, i.e., in a direction parallelling the axis of the cylinder. When positioned in the manner just referred to, it will be clear from inspection of FIG. 2 that the flow of fuel through the valve ports controlled by the reed valves or petals 24 and 25 substantially directly enters the passages downstream of the valves, without the necessity for any extensive or sharp angular deflection. Similarly, the flow of the fuel into the inclined passages 26*b* when the reed valves 26*a* are opened is a substantially direct flow not requiring sharp or extensive angular change in direction. These and other factors are of importance in maximizing the input of fuel into the engine.

The above mentioned directness of flow is enhanced by virtue of the arrangement as shown in which a pair of reed valve assemblies are mounted in separate generally parallel intake passages 27, 27, as established by intervening wall structure including partition 28.

As above indicated, a plurality of injector passages are provided at each side of the cylinder; and in the embodiment of FIGS. 1, 2 and 5, where a single transfer passage is provided at each side of the cylinder, there are two injector passages at each side, both of which interconnect the fuel inlet means with the same transfer passage. Thus, in this embodiment, there are provided injector passages 30—30 in the form of a pair of cavities each recessed in the wall of the cylinder in a position in which its open side confronts an outer side wall portion of the piston 14. These passages are of open construction, facilitating casting of the cylinder, making possible the employment of injector passages of larger cross section, and promoting smoother fluid flow. The outer side wall of piston 14 provides the inner wall limit (considered radially of the cylinder) of each injector passage 30, as appears in FIG. 2, and each interconnects one of the intake ports 29 with the transfer passage at that side of the cylinder. The connection or junction of the injector passage with the transfer passage is immediately adjacent to the transfer port 21; and this junction is preferably arranged in the same manner as described below with reference to the injector passages **30*b* of the embodiment described below and particularly shown in FIG. 6**.

The injector passages 30 are similar in general function to passages described and claimed in U.S. Pat. No. 3,905,341, being open throughout the complete cycle and serving to increase intake of fuel throughout the RPM range of the engine. When the charge contained in the crankcase 16 is pressurized by the descending piston 14, such charge flows upwardly through the transfer passages 19 to the transfer ports 21 and into the cylinder. This flow takes place at high velocity; and the rapidly moving charge in the passage 19 causes an eductor effect in the injector passages 30 which, in turn, causes relatively low pressure to exist through such passages. Accordingly, fuel is drawn from the intake tract downstream from the valve assembly, through the injector passages 30, and into the transfer passages 19. Here again, it is to be noted that the arrangement of the passages and ports provided by the present invention is such as to provide for only one-way flow in any one passage.

A second pair of injector passages is provided at each side of the cylinder in the embodiment shown in FIGS. 1, 2 and 5. Each of these additional injector passages is indicated at **30*a*, and from FIG. 1, it will be seen that these passages are downwardly inclined. Each of these passages interconnects the intake system with the transfer passage 19** at that side of the cylinder in a position close to the lower end of the transfer passage, so that the injector passages at each side of the cylinder are associated respectively with the upper and the lower portions of the transfer passage.

As is pointed out in U.S. Pat. No. 3,905,341, and graphically portrayed therein the peak horsepower of an engine is raised considerably by the use of injector porting. By employing the porting, especially in combination with the extended intake porting characteristic of various embodiments of the present invention, I have found that it is possible to further increase fuel delivery throughout the cycle, and thereby to maximize power. This is particularly true with respect to the multiple injector port arrangements of the present application.

With reference to the orientation of the engine and reed valves as shown in FIG. 1, it should be kept in mind that in many installations, particularly in motorcycles and snowmobiles, the intake passage of a two-cycle engine, and also the engine itself, is somewhat inclined in a direction such that liquid fuel tends to flow from the carburetor (not shown) to the intake passage or chamber 22 and toward intake port 29. Such inclination is shown in FIG. 1.

The injector passages are each arranged at a substantial angle with respect to the axis of the adjacent transfer passage 19, which terminates in the transfer port 21. As will be appreciated, the port of each transfer passage lies above the piston 14 when the latter, as shown fragmentarily in FIG. 1, occupies its bottom dead center position (BDC).

Figure 3:
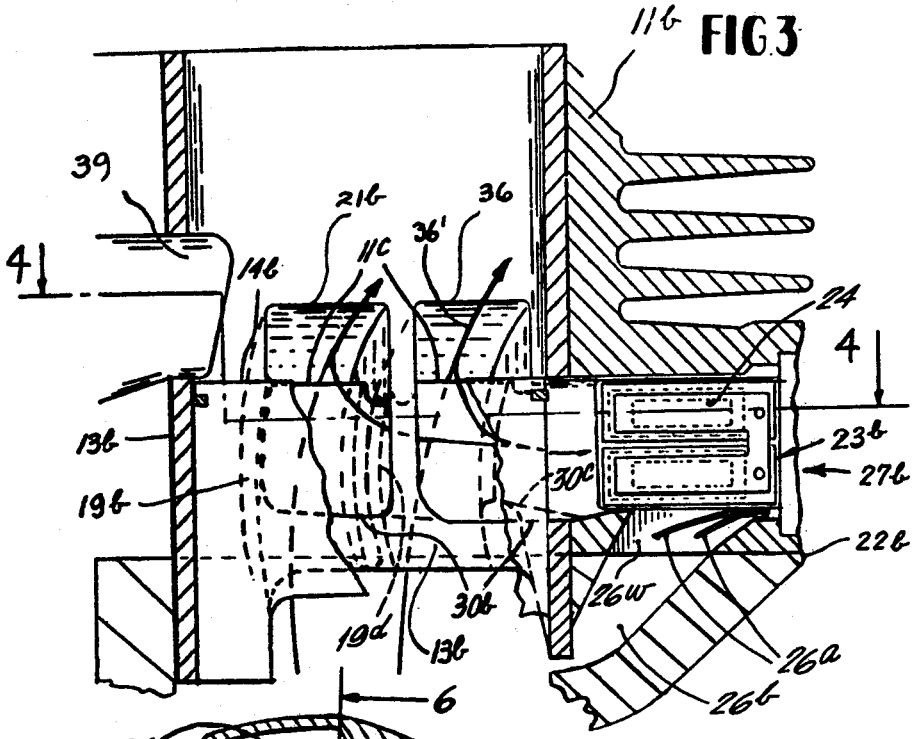
FIG. 3 is a somewhat diagrammatic sectional view generally similar to FIG. 1, but omitting the crankcase, the view being taken along the line 3—3 of FIG. 4 and illustrating another embodiment of the invention.
Figure 4:
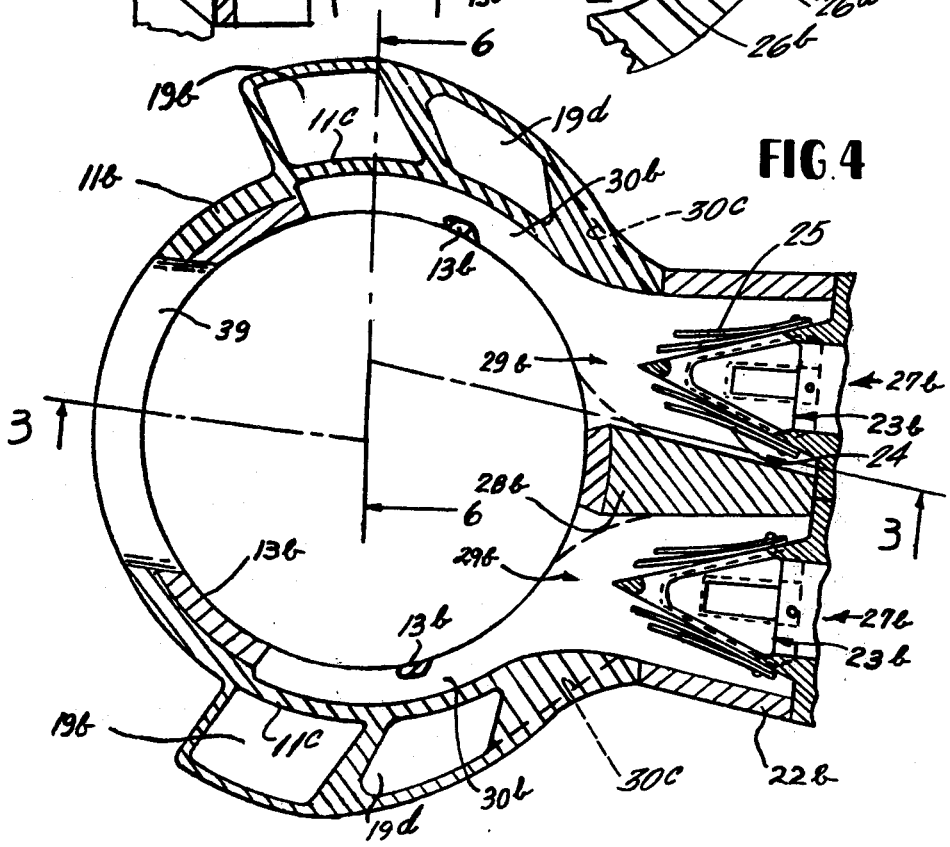
FIG. 4 is a sectional view taken along the line 4—4 of FIG. 3.

Turning now to the embodiment of FIGS. 3, 4 and 6, it is first point out that instead of employing only a single port and passage at each side of the cylinder, a pair of adjacent ports are employed, each opening separately into the combustion space of the cylinder, as seen most clearly in FIG. 3. As in the first embodiment described, two reed cages, here indicated at **23*b***, with associated valves are provided, each having vented reeds at the opposite inclined surface of the cage, as well as at the bottom wall.

In FIGS. 3, 4 and 6, one of the transfer passages at each side of the cylinder is indicated at **19*b*, and the other transfer passage at each side of the cylinder is indicated at 19*d*. The passage 19*b* has a port 21*b* opening into the cylinder above the piston when the piston is at BDC, and the transfer passage 19*d* has an opening indicated at 36**.

Separate injector passages are provided for each of the transfer passages in this embodiment. Thus, an injector passage **30*b* is provided at each side of the cylinder and communicates with the transfer passage 19*b* immediately adjacent to the port 21*b* into the cylinder, this relationship appearing not only in FIG. 3 but also being clearly evident in FIG. 6. This injector passage 30*b* communicates with the transfer passage 19*d*, in the same general manner as the communication with the transfer passage 19*b***.

Each of the injector passages **30*b*** is in the form of a hogged out channel in the cylinder wall so that the piston itself forms one wall of these injector passages.

It will be noted from FIGS. 3 and 4 that while the cylinder liner is cut out in areas providing various ports, a portion indicated at **13*b* at each side of the cylinder remains, in order to provide cylinder wall surface for cooperation with the piston and support of the piston ring. The injector passages 30*b* extend from the inlet porting 29*b* to and beyond the liner strips 13*b***, in order to provide for injector passage communication with boyh of the two transfer passages at opposite sides of the cylinder.

One of these strips **13*b* of the cylinder liner also appears in the sectional view of FIG. 6 which further illustrates still another feature incorporated in the embodiment shown in FIGS. 3, 4 and 6. Note that in FIG. 6 one of the transfer passages 19*b* is illustrated, as is the associated injector passage 30*b*, and it will be seen that a wall 11*c* (see also FIG. 3) lies between the transfer passage and the injector passage. This wall has an edge lying close to the lower edge of the port of the transfer passage into the cylinder above the piston, the edge preferably also being tapered so that it is thin at its free edge; and because of this arrangement, and further because the cross-sectional flow area of the transfer passage 19b** progressively diminishes as the port into the cylinder is approached, a substantial Venturi action is established, resulting in accentuating introduction of fuel from the injector port.

Separate injector passages 30c serve to interconnect the transfer passages 19d at each side of the cylinder with the intake system, these injector passages being formed within the wall structure of the cylinder, rather than being hogged out of the cylinder wall as in the case of the open channels 30b. It will be noted that the injector passages 30c are connected with the transfer passages 19d at points spaced downwardly from the ports 36 in the cylinder wall, so that as in the first embodiment, in the embodiment of FIGS. 3, 4 and 6, one of the injector passages at each side of the cylinder is connected with a transfer passage immediately adjacent to its opening into the cylinder, whereas the other injector passage is connected with a transfer passage at a point spaced from the port into the cylinder.

It will also be seen that in both embodiments, the two types of injector passages at each side of the cylinder are arranged with portions of the two passages at least in part overlapping each other both radially and axially of the cylinder. In each embodiment, moreover, one of the injector passages at each side of the cylinder is formed as an inwardly open channel and the other extends within the structure of the cylinder wall.

In the embodiment of FIGS. 3, 4 and 6, the passage 26b described above in connection with the first embodiment is similarly arranged, except that this passage receives fuel only from the reed valves 26a at the bottom of the reed cage. The separation of this intake passage 26b from the other intake passages is effected by an intervening wall of the cylinder structure indicated at 26w. In view of this arrangement, while the reed valves 24 and 25, and the reed valves 26a will all supply fuel for direct inlet into the crankcase at various times in the cycle of the engine, the reed valves 24 and 25 on the one hand and the reed valves 26a on the other hand, serve respectively to supply fuel to the injector passages 30b and 30c, in which respect the arrangement of FIGS. 3, 4 and 6 is distinguished from the arrangement of FIGS. 1, 2 and 5. The separate reed valve control for the two types of injector passages in the embodiment of FIGS. 3, 4 and 6 is advantageous because the pressure conditions in the individual injector passages may differ and the flow into one injector passage is not influenced by the pressure conditions in the other injector passage.

Numerous advantages flow from the arrangements of the two embodiments illustrated and described, including substantial increase in the overall quantity of fuel "injected" into the combustion chamber under the influence of the transfer of compressed fuel from the crankcase into the combustion chamber. Moreover, with the two different types of injector passages utilized in each embodiment at each side of the cylinder, although each type of injector passage operates with increasing fuel injection effect with increase in engine speed, one of the types of injector passages operates with greater increase in fuel injection effect with increase in engine speed, as compared with the increase in the fuel injection effect of the other passage. By virtue of this combined use of the two types of injector passages, it is possible to achieve very high fuel injection effect, throughout the engine RPM and with the injector passages of minimum total cross-sectional area.

Still further, the utilization of the two types of injector passages (one open channel and the other formed within the wall) at each side of the cylinder is structurally advantageous. Use of both types avoids multiple use of the same type at each side of the cylinder. Because of the importance of maintaining as much as possible of the cylinder wall in an uninterrupted condition, in order to adequately support the piston and piston rings, it is advantageous that in the arrangement herein disclosed only one of each pair of injector passages at each side of the cylinder is formed as an inwardly open channel. On the other hand, because of the importance of maintaining substantial strength in the cylinder wall structure, it is advantageous that in the embodiments of the present invention only one of the injector passages at each side of the cylinder is formed within the wall structure in the region lying between the transfer passages and the intake chambers.

I claim·

1. A variable speed, two-cycle crankcase compression, internal combustion engine, comprising: engine housing structure including a cylinder and a crankcase, a piston mounted for reciprocation in the cylinder between top and bottom dead center positions; transfer passage means in communication with the crankcase and having porting through the cylinder wall for supplying, to the combustion side of the piston, fluid compressed in the crankcase during movement of the piston toward its bottom dead center position; a fuel intake chamber for receiving fuel from a supply source, and having intake porting in the housing structure positioned to deliver fuel to the space below the piston including the crankcase, said intake porting including portions configured and positioned to provide for introduction of fuel beneath the piston and into said space independently of the transfer passage means throughout the entire upward stroke of the piston, from substantially the bottom dead center position to substantially the top dead center position thereof; reed valve means for controlling the flow of fluid through the intake chamber and substantially preventing flow of fluid back toward such supply source during downward movement of the piston toward its bottom dead center position; and injector passage means connected with the intake chamber and with said transfer passage means for delivering fuel directly to the combustion side of the piston without compression in the crankcase, said injector passage means including two passages each in communication with said intake chamber downstream of said reed valve means, a first of the injector passages communicating with the transfer passage means immediately adjacent the transfer porting through the cylinder wall, and the second of the injector passages communicating with the injector passage means in a region spaced from the transfer porting through the cylinder wall.

2. An engine as defined in claim 1 in which the first and second injector passages communicate with a single transfer passage.

3. An engine as defined in claim 1 in which the transfer passage means includes at least two transfer passages and in which the first and second injector passages are respectively connected with different transfer passages.

4. An engine as defined in claim 1 in which said first injector passage comprises an open channel formed in the wall of the cylinder and in which said second injector passage is formed within the cylinder wall structure.

5. An engine as defined in claim 1 in which the transfer passage means includes two transfer passages at each side of the cylinder and in which the injector passage means includes first and second passages at each side of the cylinder respectively connected with the first and second transfer passages.

6. An engine as defined in claim 1 in which the transfer passage means includes at least two transfer passages toward one side of the cylinder spaced circumferentially of the cylinder different distances from the intake chamber, said first injector passage comprising an open channel formed in the wall of the cylinder and communicating with that one of the transfer passages which is more remote from the intake chamber, and said second injector passage being formed in the cylinder wall structure at least in part radially outboard of the base of said channel and communicating with the other transfer passage.

7. An engine as defined in claim 1 in which the transfer passage means includes first and second transfer passages toward one side of the cylinder spaced circumferentially of the cylinder different distances from the intake chamber, the first and second injector passages being at least in part offset from each other axially of the cylinder.

8. An engine as defined in claim 1 in which the transfer passage means includes first and second transfer passages toward one side of the cylinder spaced circumferentially of the cylinder different distances from the intake chamber, the first and second injector passages being at least in part offset from each other radially of the cylinder.

9. A variable speed, two-cycle crankcase compression, internal combustion engine, comprising: engine housing structure including a cylinder and a crankcase, a piston mounted for reciprocation in the cylinder between top and bottom dead center positions; first and second transfer passages in communication with the crankcase and having separate openings through the cylinder wall for supplying, to the combustion side of the piston, fluid compressed in the crankcase during movement of the piston toward its bottom dead center position; a fuel intake chamber for receiving fuel from a supply source, and having intake porting in the housing structure positioned to deliver fuel to the space below the piston including the crankcase independently of the transfer passages; said first transfer passage being spaced from the intake chamber circumferentially of the cylinder a greater distance than said second transfer passage; reed valve means for controlling the flow of fluid through the intake chamber and substantially preventing flow of fluid back toward such supply source during downward movement of the piston toward its bottom dead center position; and first and second injector passages connected with the transfer passages and with the intake chamber to receive fuel from the intake chamber and supply it to said transfer passages and thus directly deliver such fuel to the combustion side of the piston without compression thereof in the crankcase, the first injector passage comprising an open channel formed in the wall of the cylinder and communicating with that one of the transfer passages which is more remote from the intake chamber, and the second injector passage being formed within the cylinder wall structure and communicating with the transfer passage which is closer to the intake chamber.

10. An engine as defined in claim 9 in which said first injector passage has a juncture with the first transfer passage closer to the opening of said first transfer passage into the cylinder, as compared with the point of juncture of said second injector passage with said second transfer passage.

11. An engine as defined in claim 10 in which the juncture of the first injector passage with the first transfer passage is located close to the opening of the first transfer passage into the cylinder and is configured to establish a Venturi action drawing fluid from the injector passage into the fluid stream flowing through the opening of the transfer passage into the cylinder.

12. A variable speed, two-cycle crankcase compression, internal combustion engine, comprising: engine housing structure including a cylinder and a crankcase, a piston mounted for reciprocation in the cylinder between top and bottom dead center positions; first and second transfer passages in communication with the crankcase and having porting through the cylinder wall for supplying, to the combustion side of the piston, fluid compressed in the crankcase during movement of the piston toward its bottom dead center position; fuel intake means for receiving fuel from a supply source, and having intake porting in the housing structure positioned to deliver fuel to the space below the piston including the crankcase independently of the transfer passages; said first transfer passage being spaced from the intake chamber circumferentially of the cylinder a greater distance than said second transfer passage; valve means for controlling the flow of fluid through the intake means and substantially preventing flow of fluid back toward such supply source during downward movement of the piston toward its bottom dead center position; said first and second injector passages connected, respectively with the first and second transfer passages, and with the intake means to receive fuel therefrom and supply it to said transfer passages and thus directly deliver such fuel to the combustion side of the piston without compression thereof in the crankcase, the first injector passage having a juncture with the first transfer passage at a point closer to the transfer porting into the cylinder than the point of juncture of the second injector passage with the second transfer passage, and the first and second injector passages being extended in the cylinder wall in positions with the first injector passage at least in part above the second injector passage.

13. An engine as defined in claim 12 in which at least one of said injector passages is formed within the cylinder wall structure.

14. An engine as defined in claim 12 in which first injector passage comprises an open channel formed in the wall of the cylinder.

15. An engine as defined in claim 14 in which the second injector passage is formed within the cylinder wall structure.

16. A variable speed, two-cycle crankcase compression, internal combustion engine, comprising: engine housing structure including a cylinder and a crankcase, a piston mounted for reciprocation in the cylinder between top and bottom dead center positions; first and second transfer passages in communication with the crankcase and having porting through the cylinder wall for supplying, to the combustion side of the piston, fluid compressed in the crankcase during movement of the piston toward its bottom dead center position; fuel intake means for receiving fuel from a supply source, and having intake porting in the housing structure positioned to deliver fuel to the space below the piston including the crankcase independently of the transfer passages; and injector passage means for injecting fuel from the intake means into the transfer fuel flow without compression in the crankcase, the injector passage means including at least two passages both of which operate with increasing fuel injection effect with increase in engine speed but one of which passages operates with greater increase in fuel injection effect with increase in engine speed than the other passage.

17. A variable speed, two-cycle crankcase compression, internal combustion engine, comprising: engine housing structure including a cylinder and a crankcase, a piston mounted for reciprocation in the cylinder between top and bottom dead center positions; transfer passage means in communication with the crankcase and having porting through the cylinder wall for supplying, to the combustion side of the piston, fluid compressed in the crankcase during movement of the piston toward its bottom dead center position; fuel intake means for receiving fuel from a supply source, and having intake porting in the housing structure positioned to deliver fuel to the space below the piston including the crankcase, and intake porting including portions configured and positioned to provide for introduction of fuel beneath the piston and into said space independently of the transfer passage means throughout the entire upward stroke of the piston, from substantially the bottom dead center position to substantially the top dead center position thereof; injector passage means connected with the intake means and with said transfer passage means for delivering fuel directly to the combustion side of the piston without compression in the crankcase, said injector passage means including two passages each in communication with said intake means, a first of the injector passages communicating with the transfer passage means immediately adjacent the transfer porting through the cylinder wall, and the second of the injector passages communicating with the injector passage means in a region spaced from the transfer porting through the cylinder wall; and reed valve means for controlling the flow of fuel through the intake means and including separate reed valves for respectively controlling the fuel flow into the first and second injector passages and substantially preventing fuel flow back toward the supply source during downward movement of the piston toward its bottom dead center position.

* * * * *

UNITED STATES PATENT AND TRADEMARK OFFICE

CERTIFICATE OF CORRECTION

PATENT NO. : 4,143,626

DATED : March 13, 1979

INVENTOR(S) : Eyvind Boyesen

It is certified that error appears in the above-identified patent and that said Letters Patent are hereby corrected as shown below:

Col. 8, line 21, (page 17, last line) after "single" insert --transfer--.

Col. 13, line 25, (Claim 17, line 13) "and" should read --said--.

Signed and Sealed this

Nineteenth Day of June 1979

[SEAL]

*Attest:*

RUTH C. MASON
*Attesting Officer*

DONALD W. BANNER
*Commissioner of Patents and Trademarks*